US007481232B2

(12) United States Patent
Apple

(10) Patent No.: US 7,481,232 B2
(45) Date of Patent: Jan. 27, 2009

(54) MAIN EVENT UMBRELLA

(75) Inventor: Phillip C. Apple, Mt. Pleasant Mills, PA (US)

(73) Assignee: American Holtzkraft, Inc, Mt. Pleasant Mills, PA (US)

( * ) Notice: Subject to any disclaimer, the term of this patent is extended or adjusted under 35 U.S.C. 154(b) by 690 days.

(21) Appl. No.: 10/650,949

(22) Filed: Aug. 28, 2003

(65) Prior Publication Data

US 2005/0045219 A1 Mar. 3, 2005

(51) Int. Cl.
*A45B 25/14* (2006.01)

(52) U.S. Cl. ..... 135/22; 135/16; 135/20.3; 135/28; 135/31

(58) Field of Classification Search ..... 135/98, 135/99, 122, 16, 20.3, 28–31, 381, 22, 38; 362/102; 52/66, 83
See application file for complete search history.

(56) References Cited

U.S. PATENT DOCUMENTS 1,397,794 A * 11/1921 Chase ..... 135/31
2,224,882 A * 12/1940 Peck ..... 135/98
3,252,468 A * 5/1966 Militano ..... 135/28
3,454,022 A * 7/1969 Ferguson ..... 135/15.1
3,530,623 A * 9/1970 Burton ..... 52/86
3,870,062 A * 3/1975 Medlin ..... 135/20.3
4,424,824 A * 1/1984 Becher ..... 135/20.3
4,572,226 A * 2/1986 Williams et al. ..... 135/22
5,291,908 A * 3/1994 Grady, II ..... 135/22
5,329,953 A * 7/1994 Becher ..... 135/31
5,386,842 A * 2/1995 Becher ..... 135/20.3
5,444,943 A * 8/1995 Schelfhorst ..... 52/63
5,765,582 A * 6/1998 Molnar, IV ..... 135/16
6,543,464 B1 * 4/2003 Grady, II ..... 135/20.3
6,732,753 B2 * 5/2004 Chang ..... 135/20.3

FOREIGN PATENT DOCUMENTS

DE 19507967 A1 * 9/1996
WO WO 9944459 A1 * 9/1999

OTHER PUBLICATIONS

"Market Umbrellas & Outdoor Furnishings" Brochure, American Holtzkraft Inc. pp. 21-22. 2002.*
"MegaShade collection", American Holzkraft Inc. web site from www.holfzkraft.com, p. 1 of 1, Feb. 25, 2002, & pp. 1 of 2, Aug. 31, 2005.*

* cited by examiner

*Primary Examiner*—Winnie Yip
(74) *Attorney, Agent, or Firm*—Mark C. Jacobs

(57) ABSTRACT

An umbrella having opposed moving hubs, one upper and one lower, to which is attached a series of spaced spars to the upper hub and a series of spaced ribs to the lower hub. The ribs are also connected one rib to one spar. An acme-threaded rod passes through an acme nut mounted on each hub, one left hand threaded and one right hand threaded, such that the rod, when connected to a drive shaft and gear motor, and actuated causes the hubs to move toward each other to close the umbrella and away from each other to open the umbrella. The umbrella is covered over by a canopy attached thereto.

24 Claims, 8 Drawing Sheets

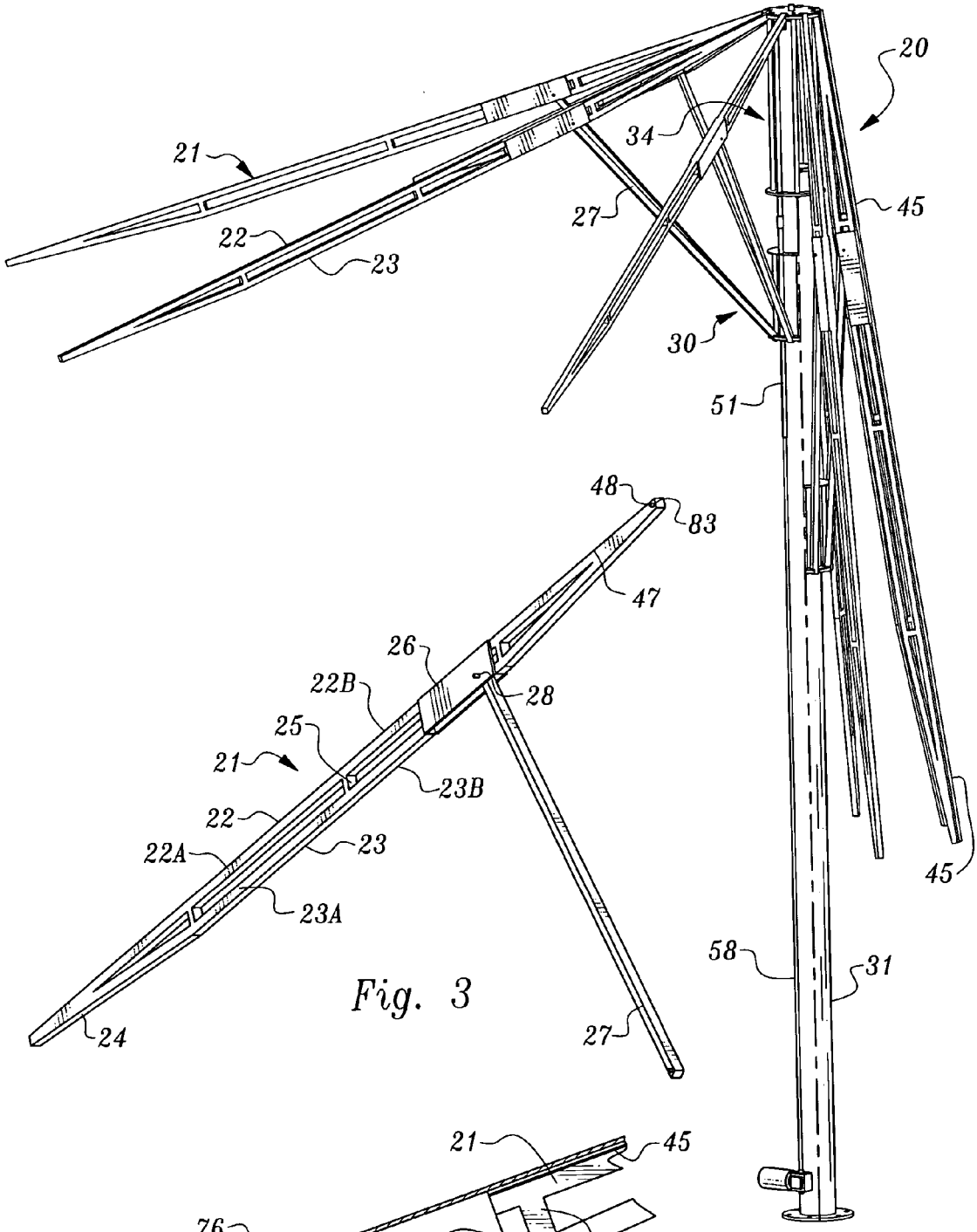
Fig. 1
Fig. 3
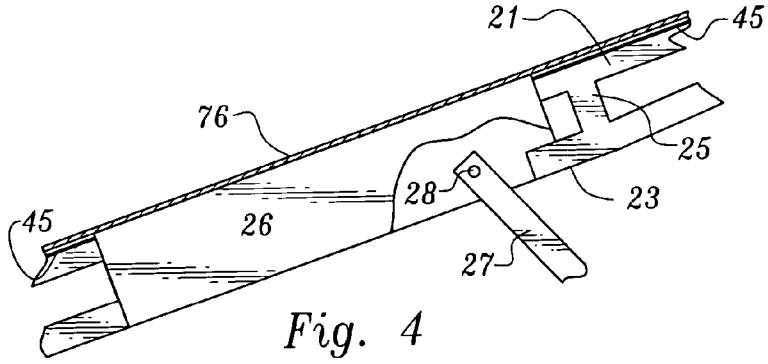
Fig. 4

MAIN EVENT UMBRELLA

FIELD OF THE INVENTION

This application pertains to large umbrellas used for garden and patio entertaining, which umbrellas can range in size from about 25 to 40 feet in diameter and even larger.

BACKGROUND OF THE INVENTION

The use of table mounted umbrellas and cabanas to provide a source of shade from the sun, and from rain, during the course of an outdoor event. Many patents for umbrellas in the 6 to 12 foot diameter ranges are well known. One such patent for an umbrella construction is that of Apple, U.S. Pat. No. 5,020,557, issued Jun. 4, 1991. Another patent pertaining to improvements in umbrella technology is that of Tung, U.S. Pat. No. 4,878,509 issued Nov. 7, 1989. A typical patented cabana is that of Sandberg U.S. Pat. No. Des. 361,363 issued Aug. 15, 1995.

Most four post cabanas and the umbrellas known to applicant are to be mounted in one of several ways, such as through a bore in the middle of a 4-6 ft. wide table to cover those persons sitting at the table, or bear a pointed shaft at the lower end, for a rocking motion insertion in the sand of a beach, again to shield a few persons sitting there beneath, or are to be inserted in a freestanding, weighted, conventional umbrella stand, again to shield any number from one to say eight persons from the undesired element of nature, be it sun or rain.

There has been demonstrated a need for an umbrella that will shield an even larger group of people, such as may be found at caterers' tables as for instance at an outdoor wedding, or other function. Another use for a large umbrella would be to create shade for a row of beach chairs. Thus, a need for an umbrella to span distances of from about 25 to 40 feet or even greater was found to exist.

The invention accordingly comprises the device possessing the features properties and the relation of components which are exemplified in the following detailed disclosure and the scope of the application of which will be indicated in the appended claims, for the umbrella of this invention.

For a fuller understanding of the nature and objects of the invention reference should be made to the following detailed description, taken in conjunction with the accompanying drawings.

SUMMARY OF THE INVENTION

An easy opening and closing umbrella, of a diameter span in the range of from about 25 to about 40 feet which may be operated —opened and closed—by any of: push button, crank or wireless remote-controlled motor, which umbrella is preferably multi vented to permit excessive wind to escape through the canopy portion thereof. The umbrella features an acme rod having ½ left hand threads and ½ right hand threads disposed between a moveable upper hub and a moveable lower hub.

An optional electric gear motor and drive shaft interconnect to the acme rod to both raise (open) and lower (close) the umbrella. This can be a pushbutton (hard wired) or wireless remote controlled, or the control can be carried out with a crank. Function can also be performed by hydraulic or a cable mechanism or a compound pulley system.

It is a first object of this invention to provide an umbrella capable of being constructed to open to spans as large as 40 feet in diameter and even greater.

It is a second object to provide an umbrella capable of shielding a small crowd of people, and which umbrella can be operated by an electric motor.

It is a third object to provide an umbrella that can be remotely actuated.

It is a fourth object to provide an umbrella superstructure that employs an acme rod that moves between a pair of moveable hubs.

It is a fifth object to provide an umbrella whose opposed hubs, both move, and which are driven by a dual threaded screw.

Other objects of the invention will in part be obvious and will in part appear hereinafter.

BRIEF DESCRIPTION OF THE FIGURES

FIG. 1 is a front perspective view of the superstructure forming part of this invention.

FIG. 3 is a close-up diagrammatical view of one spar of the superstructure.

FIG. 4 is a diagrammatic view of a point of attachment employed herein.

FIG. 6 is a diagrammatic view of two halves of the umbrella of this invention, depicting its operational aspects, and wherein

DESCRIPTION OF THE PREFERRED EMBODIMENT

Figure 2:
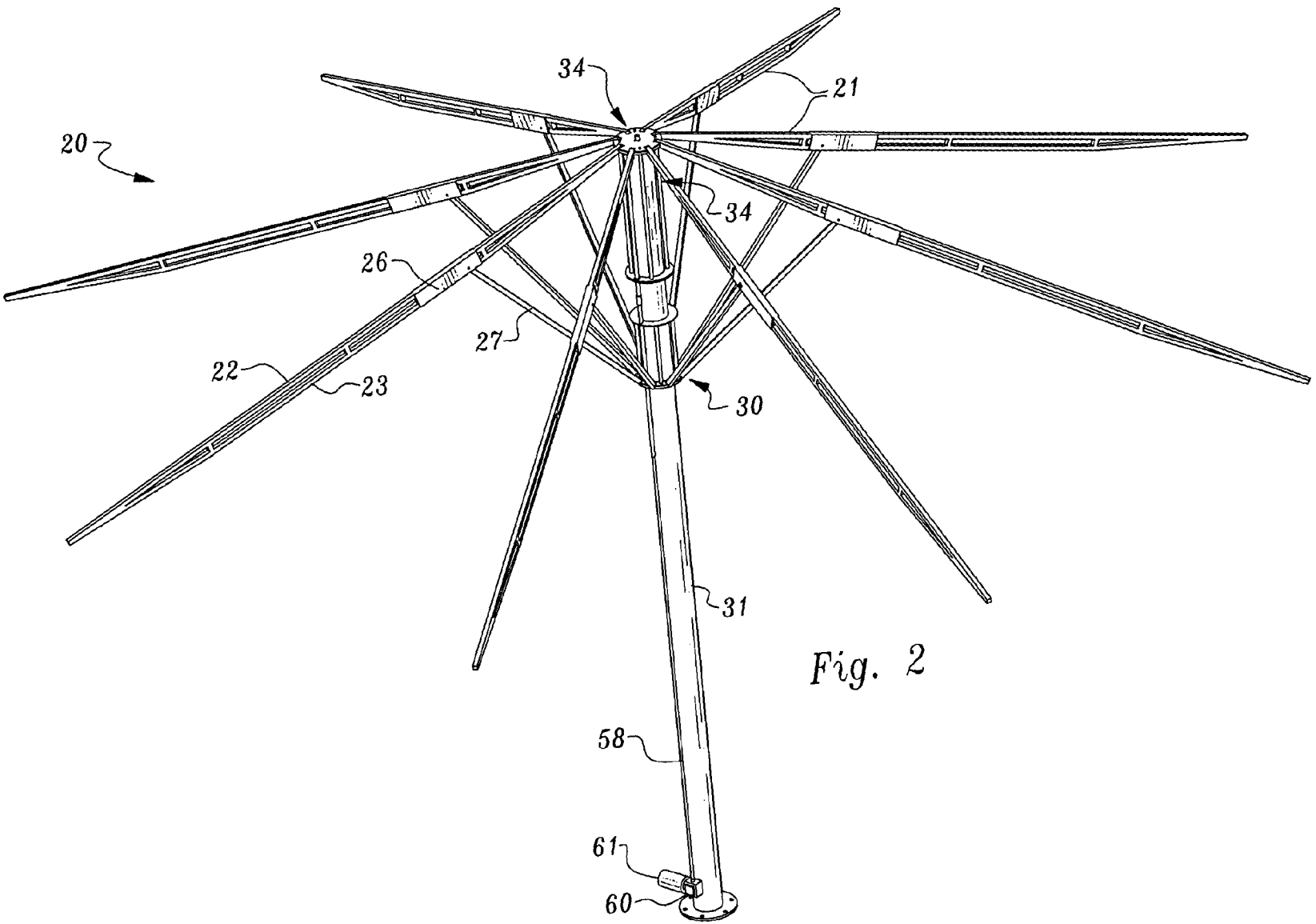
FIG. 2 is a side perspective view of the superstructure.

This invention pertains to the first dual moving hub umbrella known to applicant. That is, both the top and bottom hub move toward each other and away from each other as will be disclosed in detail. The apparatus of this invention features three portions, the first being the covering or canopy, while the second is the superstructure, upon which the canopy lies, and the third is the pole and operating mechanism. Two of these portions are seen in FIG. 1, the superstructure comprising the hubs and spars and ribs; and the pole. The inventive aspect herein lies in the superstructure construction taken in conjunction with the operating mechanism, which combination permits such a large expanse umbrella to be constructed. FIG. 1 is a composite view in that it shows part of the superstructure in a first raised position on the left side and in a second lowered position, also known as the closed position on the right side. The split is a vertical split through the pole 31.

The discussion will commence with the second portion, the superstructure seen in FIGS. 1, 2, 3 and 4. The superstructure 20 includes a series of spars 21, each of which spars 21 has an upper spar member 22 of two aligned spaced and parallel sections 22A and 22B, and lower spar member 23 which also has two aligned spaced and parallel sections 23A and 23B. All four of these sections will generally range from six to eight in number though more can be employed. Each spar 21 is generally trapezoidal in shape and has an upper long member 22 spaced from a lower short member 23. The upper and lower spar members 22,23 are connected at their extremes by angularly disposed ends 24, and by a series of member connectors, 25 at spaced locations along the length of the two members. See also FIGS. 15-17.

Each long member 22 has a pair of spaced aligned sections 22A,22B, while the lower spar member has the same, designated 23A and 23B. The member connectors 25 serve two functions, respectively for the junction of the member section 22A to 23A and for the junction of member section 22B to 23B. The member connectors 25 are aligned and disposed between the spaced long and short members and are connected to both insert aligned sections of the upper and lower spar members. See FIG. 3. Generally there are about four equally spaced member connectors, 25, which are square tubing serving this double-duty.

Figure 15:
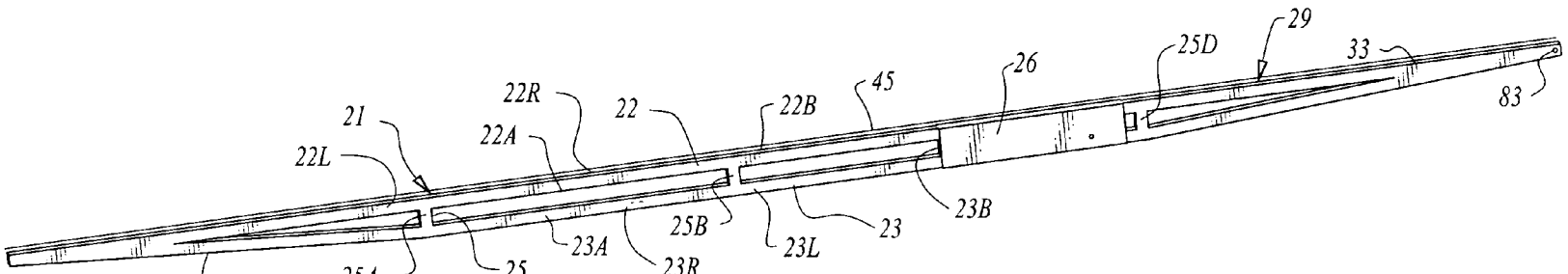
FIG. 15 is a top view of a spar that forms part of this invention.

A skin or covering 29 seen in FIG. 15 optionally connects aligned section 22A to section 22B transversly along substantially all of the length of the two aligned sections of the upper spar. If desired, section 22A, 22B, and 29 can be extruded as one piece. Each spar has a proximal end 47 with a bore 83 to receive pin 48 for disposition in slots 88 as is discussed elsewhere herein.

Disposed on the respective opposite exterior sides of the spar members—that is on each of the side surfaces, is a spaced pair of rib joiner plates, 26. One such rib joiner plate, 26, is shown in closeup in FIG. 4. Rib joiner plates 26 are each a generally rectangular shaped section, which are welded, brazed, glued, riveted or otherwise attached along the exterior surface of the spar members, 22, 23. Rib joiner plates, 26, each have a single aligned spaced aperture, 30, at the proximal end thereof. See FIG. 17. Proximal is defined as the edge of the plate closer to the pole, 31. Each rib, 27, is disposed between the two rib joiner plates, but in the interior of the spar, and the rib, 27, is retained therein by a threaded pin, 28, disposed through the bore, 28H. A suitable aligned bore is present, though not seen in each rib to permit passage of the pin, 28, there through. Pin, 28, is conventionally retained as by a lock nut, again not seen, to create a pivotal mounting. See FIGS. 3 and 4. The rib joiner plates, 26, are disposed for their connection to the spar at a point approximately ⅓ of the distance along the upper spar as measured from the upper hub.

Figure 5:
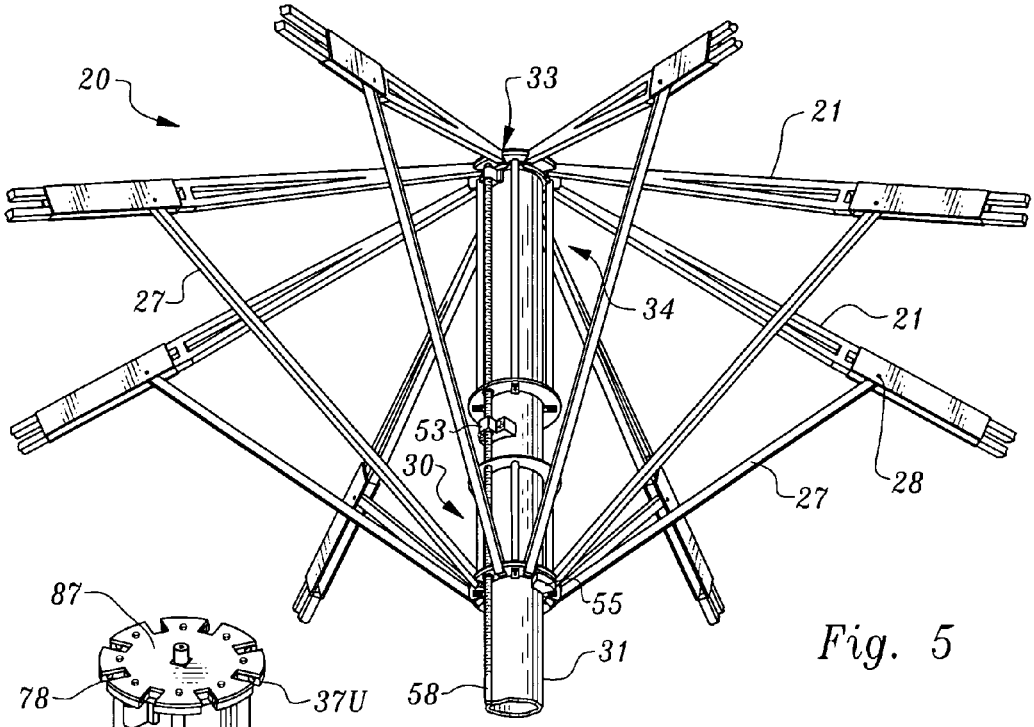
FIG. 5 is a close-up perspective view of part of the invention as seen in FIG. 1.

Thus in FIG. 5, a proximal junction, 33, which is a direct junction of a spar member to the upper hub, is seen. But for a closeup view and a full understanding of this connection the reader is directed to FIG. 11. This connection is by a pin, 48, which is disposed within a recess, 78, one of which is on both sides of slot, 88, in the upper hub, 34. This connection is completed by attaching a cover plate, 100, over each recess, 88, and securing the cover plate, 100, with suitable screws not seen. This permits the spar to pivot in its respective slot, 88, on pin, 48. Pin, 48, passes through a bore, 83, seen in FIG. 17 on end, 33, of the respective spar to secure the spar to the upper hub, 34.

Figure 18:
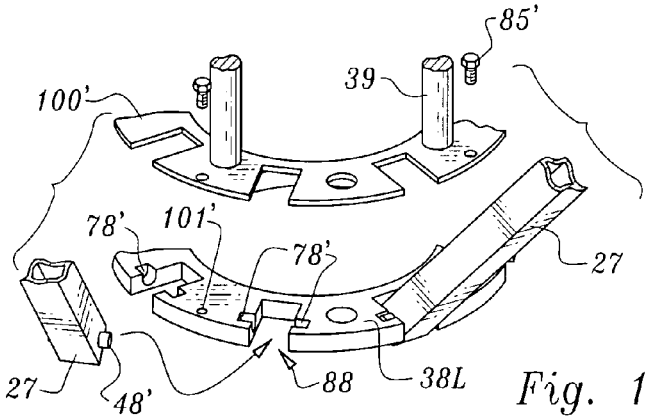
FIG. 18 is a close-up top perspective showing the connection of the rib to the lower plate prior to attachment of the cover/retainer on the lower hub.

FIG. 18 is a diagrammatic view showing the insertion of a rib for pivotal mounting, which is done in like manner. Thus a pin, 42, in rib, 27, is seen at a point in time just prior to insertion in a plate of the lower hub, whereas the spar is connected to the upper hub.

Figure 11:
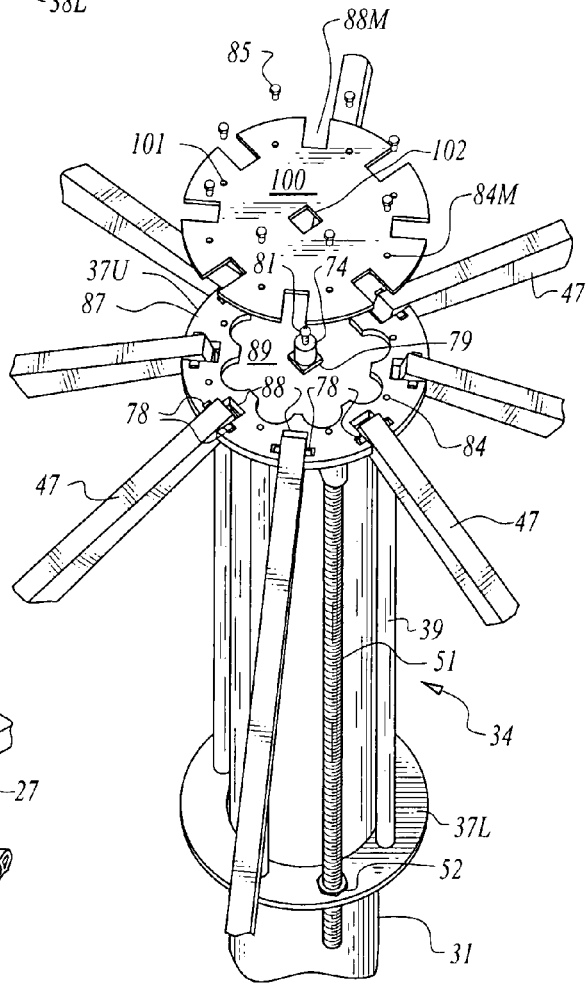
FIG. 11 is a top perspective view of the upper hub.

Reference is now made to FIG. 11, which is both an exploded view as to cover 100 and a perspective view of the upper hub, 34. Shown disposed in the center of the top plate, 37U, of the upper hub, is a recessed central area, 89, and a surrounding disklike area, 87. In the recessed area, 89, there is disposed an upstanding sheet metal square tube, 79, which is positioned to extend through the square opening, 102, of the retainer cover 100.

In this square tube there is an upstanding cylinder 74 having a threaded shaft 81 extending upwardly therefrom. This threaded shaft 81 serves to receive a female threaded finial shown elsewhere in the figures. Cylinder 74 rests in the metal square cup surround, 79, shown in FIG. 12, which cylinder may be made of brass, nylon, or Detrin®, among other materials.

Retainer cover 100 has a series of bores, 84M, adjacent each slot, 88M. Slots, 88M, align with slots, 88, when the retainer cover, 100, is put into place, and bolted with bolts, 85, via threaded bores, 84M. Bores, 84M, also align with 84, in disk, 87. The "M" designation is used because the slots of the retainer cover and the bores of the retainer cover, 100, match the deposition of the slots and threaded bores of disk, 87, of the upper plate, 37U.

Shown in FIG. 11 also, is the acme rod 51, which moves the upper hub relative to the lower hub. The acme rod passes through nut, 52, in the lower plate, 37L, of the upper hub.

Figure 10:
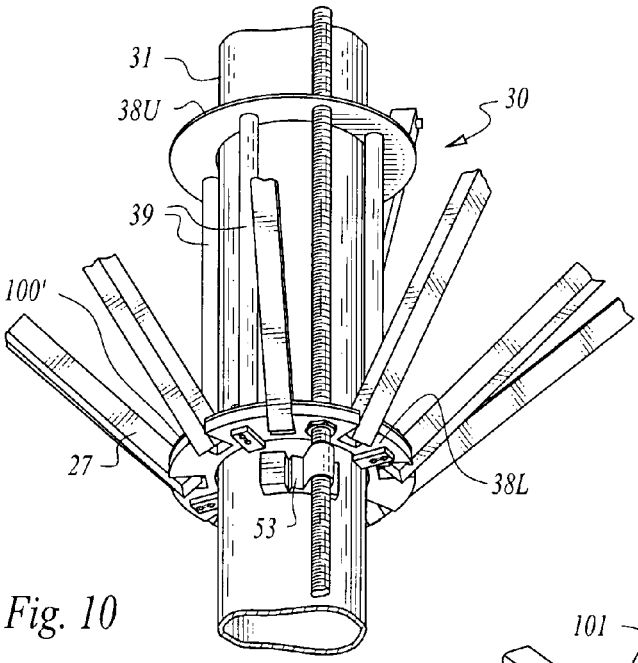
FIG. 10 is a bottom perspective view of the lower hub and several of the ribs attached thereto.
Figure 12:
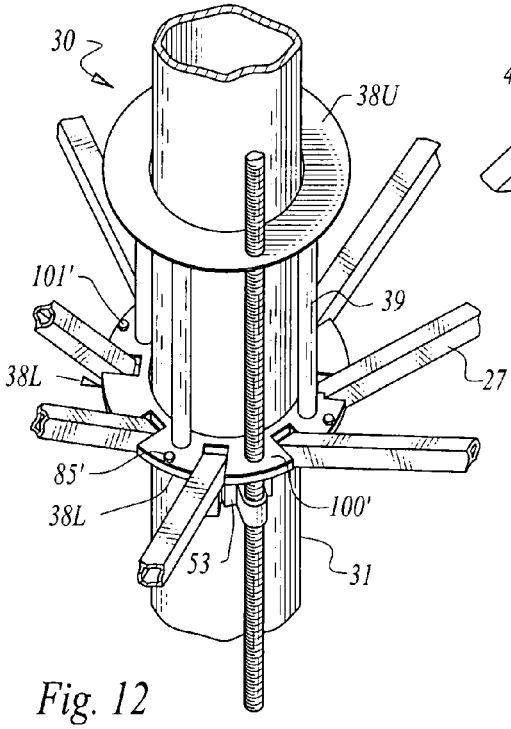
FIG. 12 is a top perspective view of the lower hub and several ribs attached to the bottom thereof.

The discussion now turns to FIG. 10 and FIG. 12, both of which relate to the lower hub. The acme rod, 51, is seen to extend between the two hubs and below the lower hub, 30. The lower hub, 30, has two spaced slots 38U and 38L connected by a series of spaced rods, 39. These rods may be welded, screwed into or otherwise attached to each of the spaced plates, 38U and 38L. These rods, 39, are the same type of rod used to connect the upper hub, 34's, upper plate, 37U, to the upper hub lower plate, 37L in the upper hub as is seen in FIG. 11.

Figure 7:
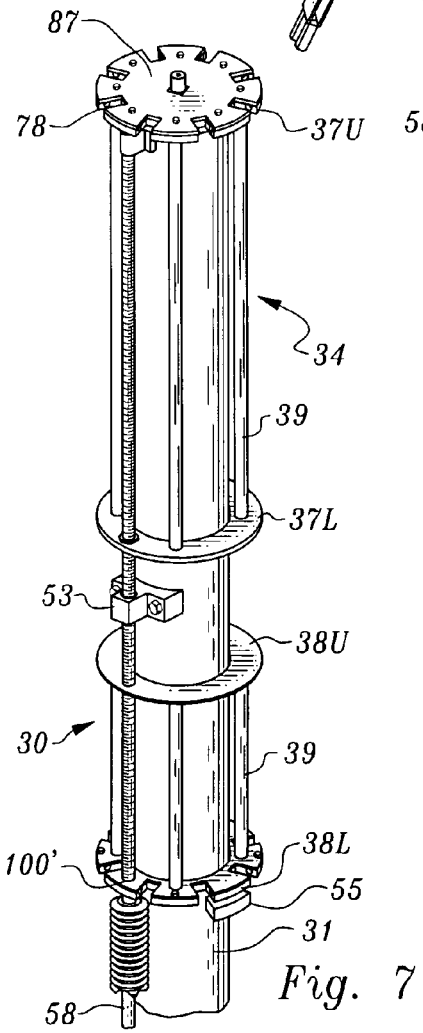
FIG. 7 is a perspective diagrammatic view of the two hubs employed herein disposed on a pole.

Main pole 31 also runs between the two hubs and below the lower hub 30. The two hubs are seen to circumscribe the main pole 31, and continue downwardly as is seen in FIG. 7 and are spaced from the pole so as to move up and down.

The mode of attachment of rods 27 to the lower plate 38L is close in the same general manner as the attachment of the spars to the upper hub. Here however the retainer plate is designated 100 prime, the bolts are 85 prime to signify their location in the lower retainer cover. The recess equivalent to 78 is present but not seen the lower plate nor is the pin equivalent to pin 48 seen. U-shaped acme rod holder 53 prevents the acme rod 51 from bending and getting out of alignment. See FIG. 12. For ease of drawing however this U-shaped acme rod holder is absent in FIG. 7. See also FIG. 18 where the slot 78 prime is shown as well as pin 48 prime in the rib 27.

Each hub of the pair, as noted before, includes an upper plate 38U, spaced from a lower plate 38L, and the two plates aforesaid are joined by a series of vertical posts 39. Similar nomenclature is used for the lower hub, wherein the parts are designated 38L and 38U as is shown. FIG. 11 also illustrates the fact that the slots for the junctions of the spars is on the top plate 37U and for the ribs on the bottom plate 38L. See FIG. 10.

Each hub, both the upper hub 34, and 30 the lower hub, have as many junction slots; namely slot 42 in plate 38L and slot 78 in plate 37U of the upper hub as there are ribs 27. Thus if 6 ribs are present, then there are 6 slots to the top plate of the upper hub and the same number in the bottom plate of the lower hub. Generally the number of ribs and spars ranges between 6 and 10 with 8 being the most common number. See FIGS. 10 and 12.

Figure 14:
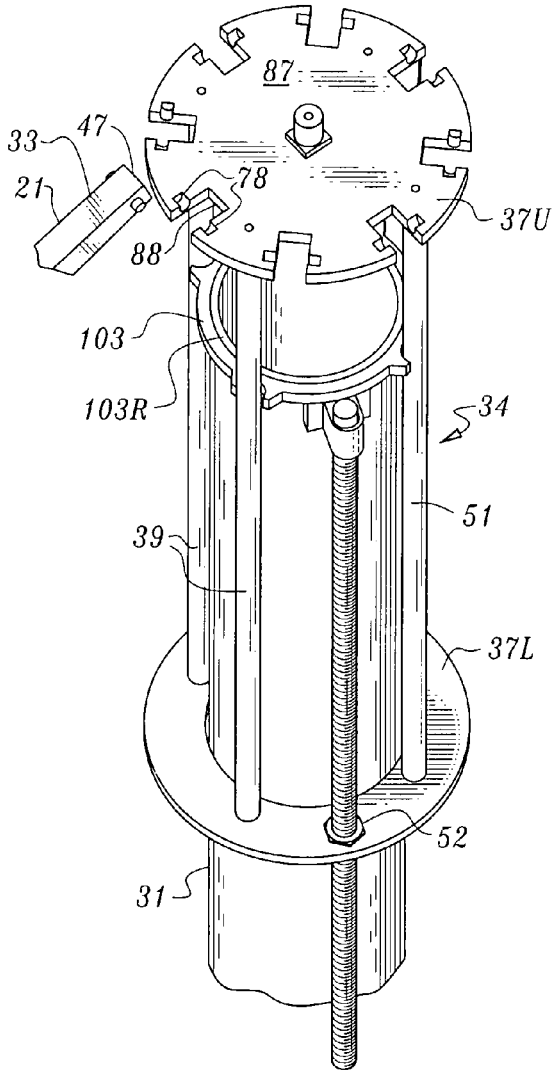
FIG. 14 is a view related to FIG. 11 at a future point in time when the cover retainer is in position which prevents the pivot pin from coming out.

The reader's attention is also turned to FIG. 14, wherein the retainer cover 100 is shown in place to keep the spar mount pin from coming out of the recesses 88 adjacent slot 78 of the upper hub.

Figure 16:
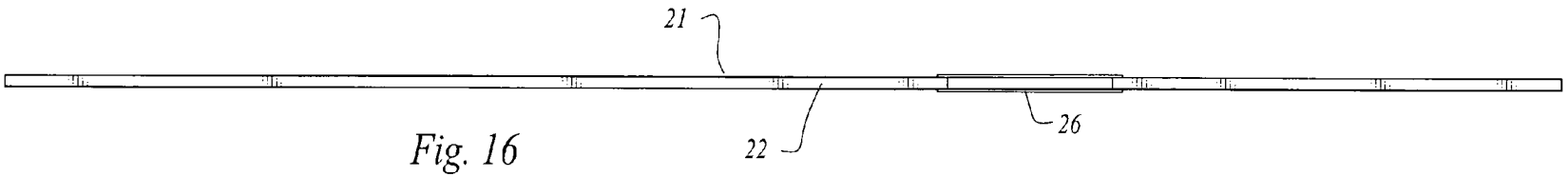
FIG. 16 is a bottom perspective view of one spar used in this invention.
Figure 17:
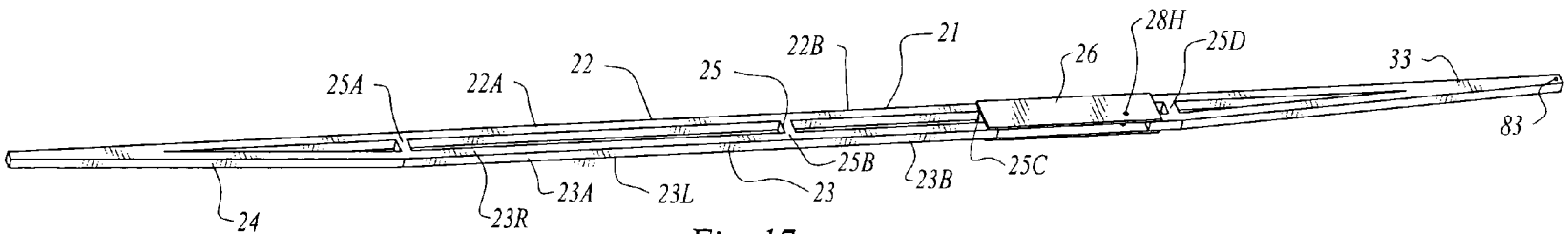
FIG. 17 is a side perspective view of one spar.

Since these connections are the same for the respective rib mounts on the lower plate of the bottom hub, per FIG. 7, all details are not shown or discussed below. Each spar such as those shown in FIGS. 15, 16 and 17 is also connected directly to a hub as well. Thus as seen in FIG. 3, the rib joiner plates 26 are disposed overlying the sides of each rib joined as noted to the upper spar member 22 and the lower spar member 23. The rib joiner plates 26, is also connected by a pin 28—FIG. 17—to a first end of a rib 27, per FIGS. 3, 4, and 5. Each rib 27 in turn is connected in like fashion at its second end to the bottom plate 38L of the lower hub 30 by a bolt pin 48 prime. Ribs 27 may be formed of square tubing of material such as of aluminum or steel.

As to the construction of each spar, unlike the ribs these are not solid members. See FIGS. 15 and 16. Each spar upper member 22 as seen in FIGS. 3 and 17 is in reality two spaced segments 22 left and 22 right, designated 22L,22R in FIG. 15. The lower members 23 are also left and right members. The left and right segments are joined by spar segment plates, 45, on both the top and bottom surfaces of the spar, as by welding except along the length the rib joiner plates 26. See FIGS. 4, 15 and 16. Note that the nomenclature for designators 23 L and R is depicted correctly reversed in these two views as one is a top perspective and the other FIG. 16 is a bottom perspective view.

FIG. 7 are each of the lower hub 34 and upper hub 30. This figure also illustrates the placement of the slots for the attachment of the spars and ribs. Since both hubs are of similar circular cross section configuration but are mirror images, the description of both is substantially the same. Each of the two hubs is shown disposed on main pole 31. While only a few rib junction points are shown on the lower and a few spar junction points are shown in the upper hub, this was done for simplicity of drawing of the figure. FIG. 5 reinforces the fact that the distance between the two plates of the respective hubs are not evenly distanced apart. The upper hub plates 37U and 37L are much further apart than are the lower hub plates. It is for this reason that the spacer 103 with recesses 103R is preferably used to provide rigidity to the posts 39 of the upper hub so that the posts do not buckle. This spacer 103 is disposed between the two plates of the upper hub from an elevational perspective, and it rests on a U-shaped holder 53 of the acme rod 51. Details are recited infra re spacer 103.

It is to be understood that the number of openings in each hub is equal to the number of ribs 27 and generally varies between 6 and 8. For ease of understanding the acme threaded rod has been omitted in FIG. 7. The upper hub is seen in detail separately in FIG. 11 and FIG. 13 while the lower hub is seen in FIG. 12. Note that the optional spacer discussed with respect to FIG. 13 is not shown here in FIG. 12.

The top plate of the upper hub and the bottom plate of the lower hub includes a series of slots and recesses, described infra. These are used for a respective spar end 33 or rib 27 connection as described earlier herein The angle between the junctions on the respective hubs is dependent upon the number of ribs and spars. If the number is only six ribs, the angle between two junctions is about 60 degrees, (6×60=360 degrees) etc.

Figure 13:
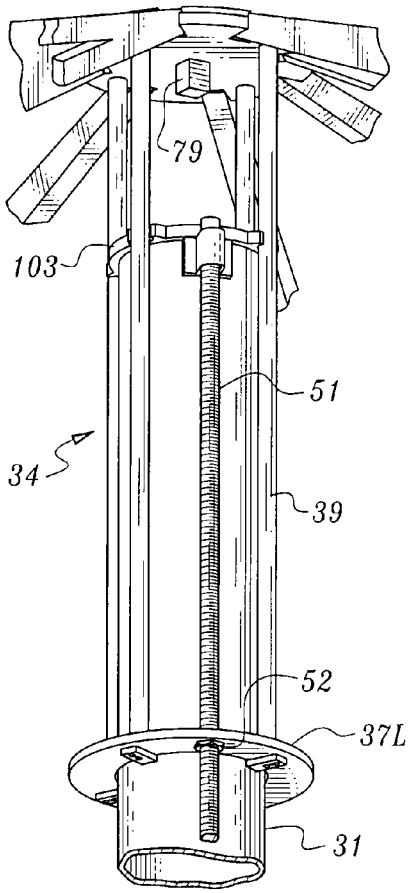
FIG. 13 is an elevational view of the upper hub and related structure.

In order to provide increased stabilization of the hubs, an optional spacer 103, constituting a plate, having a series of arcuate spaced jaw shaped recesses, 103R one per vertical post 39—can be seen in FIG. 13. The spacer is attached by drilling through each post, and placing a bolt 107 through a first aperture in the jaw shaped recess, 103R, then through the vertical post 39, and then through a second aperture in the recess. The bolt is secured by a nut not seen. The aforementioned apertures are not numerically referenced or called out on the drawing due to the scale utilized though the bolt 107 is depicted. This spacer when employed tends to reduce the torque that can be induced in the hubs from the vertical travel up and down. See FIGS. 13 and 14.

Figures 6A, 6B, 9:
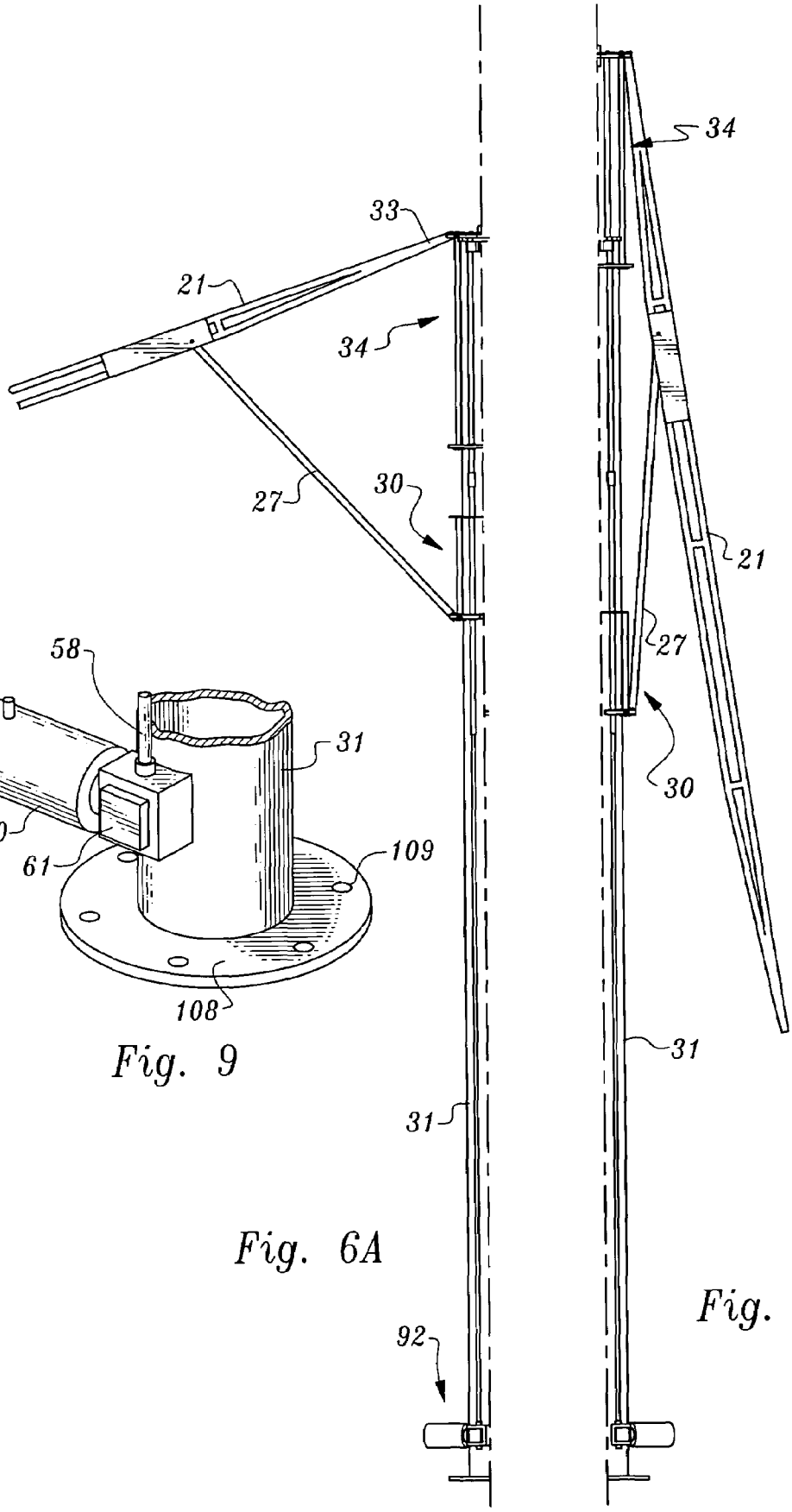
FIG. 6A shows the umbrella open and FIG. 6B shows the umbrella closed.
FIG. 9 is a perspective view of the motor and gearbox forming part of this invention.

The discussion now moves to FIG. 6, which is really a pair of figures, 6A wherein the umbrella is in the open position and 6B wherein the umbrella is in the closed position. However, reference should be made to FIG. 5 simultaneously for the details not seen in the zoomed out diagrammatic view of FIGS. 6A and 6B.

The acme-threaded rod 51 is vertically disposed parallel to pole 31 and spaced closely thereto. The term acme-threaded rod is a known article in the parlance of mechanics. (Infra) The rod is retained by a vertically spaced pair of acme-threaded nuts 52, one of which is mounted on the bottom plate 38 of the upper hub and one such nut is also mounted as by welding or brazing, or suitable cement to the top plate of the lower hub. The pair of nuts is vertically aligned to permit passage of acme-threaded rod 51. An acme rod is half threaded with right hand threads and half threaded with left hand threads. Acme rods are available in the market place from various vendors. Rod holders 53 have already been discussed.

Here the upper half of the rod is threaded normally, right-handed, while the lower half is reverse threaded left-handed. The lower end of the acme rod is connected in a conventional manner to a one end of a vertically disposed drive shaft 58, (FIGS. 2, 9) while the other end of the drive shaft, at or near the bottom of the pole is connected to a conventional gear box 60 and a motor 61. Such gear motors 61, which include a drive shaft connected to a gear system 60, are readily available in the marketplace from such vendors as McMaster-Carr. Motor 61 is electrically operated by either 110 v AC or 12 or 24 v DC power. For safety a 12 v power is preferred because small 12 v batteries are readily available to power such gear motors. A pushbutton system, not seen, is used to actuate the gear motor in the desired direction. A wireless remote control may also be used to actuate the motor. For safety sake the pushbutton should preferably be required to be held down or the power will be halted. This is akin to a deadman's switch. The gear box 60 may operate at any suitable gear ratio, such as 40:1. Plate 108 holds the main pole 31 at ground level and the plate may be attached to the ground by bolts through bolt openings 109, per FIG. 9.

Also as seen in FIG. 5, the acme rod passes through rod holder, 53, which is attached to a plate on the tube, 31. The rod holder, 53, serves to prevent the long acme rod from bending by acting as a stiffener. The stop plate, 55, seen in FIGS. 5 & 6, serves to limit the travel of each hub away from the other.

OPERATION

When the hubs are in the open position spaced from each other as in FIG. 6A, and as noted earlier in defining an acme rod, the right hand threaded nut is attached to the upper hub, 34 and the left hand thread nut is attached to the lower hub. When the rod is turned counterclockwise, the upper hub will move in an upward direction and the lower hub will move in a downward direction at the same time and same speed, to thereby close the umbrella.

Such motion is contrary to that of most umbrellas wherein the upper hub is fixed and only the lower hub moves. Contrast the open position of the upper hub in FIG. 6A with the position of the upper hub in FIG. 6B, adjacent the finial 75. Also, note the relative positions of the lower hub 30 between FIGS. 6A and 6B.

Connections of acme rods to drive shafts are deemed conventional as is the connection of a drive shaft to a gear motor. As such, no further discussion is necessary about these connections. An optional protective bellows sleeve 58 seen in FIG. 5 protects the junction of the drive shaft and the acme rod from weather and dirt.

The benefit of moving both hubs synchronously and simultaneously is to shorten the distance of hub travel which in turn shortens the time it takes to open and close the umbrella. Such movement pattern also keeps the head clearance to a minimum when the umbrella is in the open position. This allows adequate clearance between the ribs and the floor level when the umbrella is closed and in the closing process, such that picnic tables, chairs etc., need not be moved from under the spread of the umbrella. The opposed motion of this invention shortens the length of the travel of the hubs, which in turn shortens the time it takes to open and close the umbrella.

In attempting to determine the size of the pole and the span for these large umbrellas, it was concluded that there are three variables. Thus, a triangle is formed by three lines drawn through the center of the pins holding the ribs in the hubs, and the center of the bolt at the pivot point. While the length of the lines will change, the angles within the triangle will stay the same. By applying standard ratio techniques, one can size the umbrella of this invention up or down as may be desired.

Figure 19A:
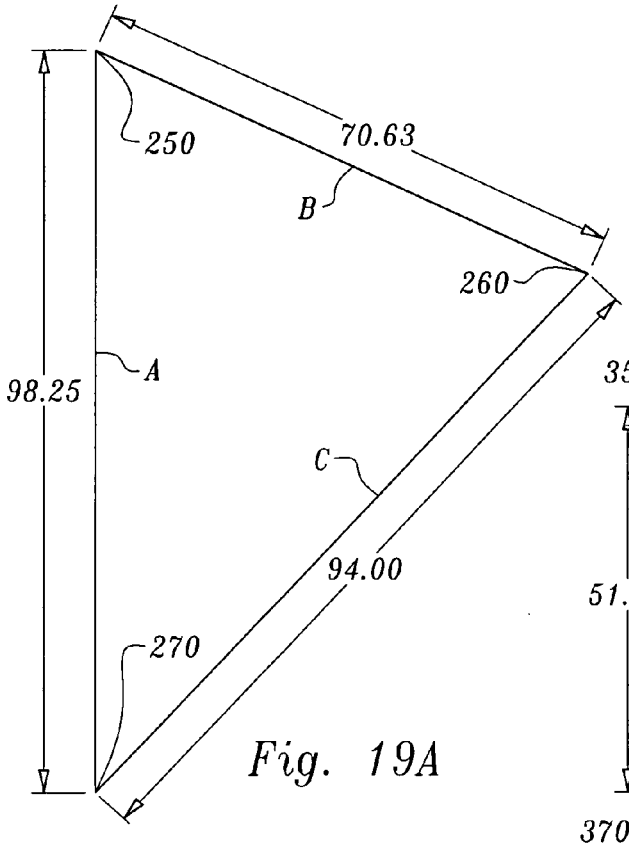
FIGS. 19A and 19B is a pair of triangles illustrating the extension of various aspects of the umbrella for two large umbrellas made according to this invention.
Figure 19B:
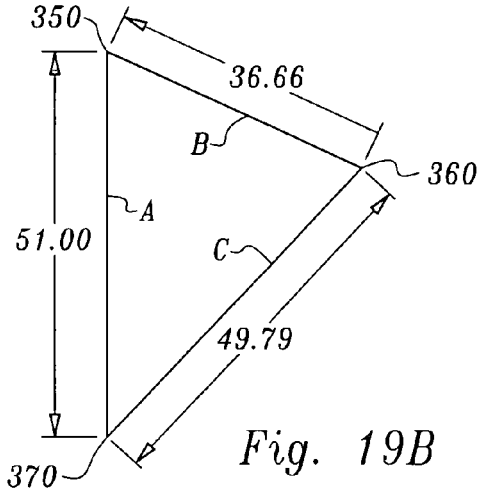

Thus in FIGS. 19A or 19B, the distance A is the aforementioned section of the pole between hubs, while Bis equal to the span from the upper hub to the rib joiner plates 26, and Cis equal to the distance from the pivot point of the rib joiner plates 26 attached to the rib 27 measured to the lower hub 30. The points have been designated 250, 260 and 270 respectively for the larger triangle and 350, 360 and 370 for the smaller one. The larger triangle pertains to a 40-foot span unit while the smaller triangle is for a 25-foot span umbrella. The measurements are taken from the points of connection on the hubs, which is at about the midpoint of the elevation of each of the two hubs.

Figure 20:
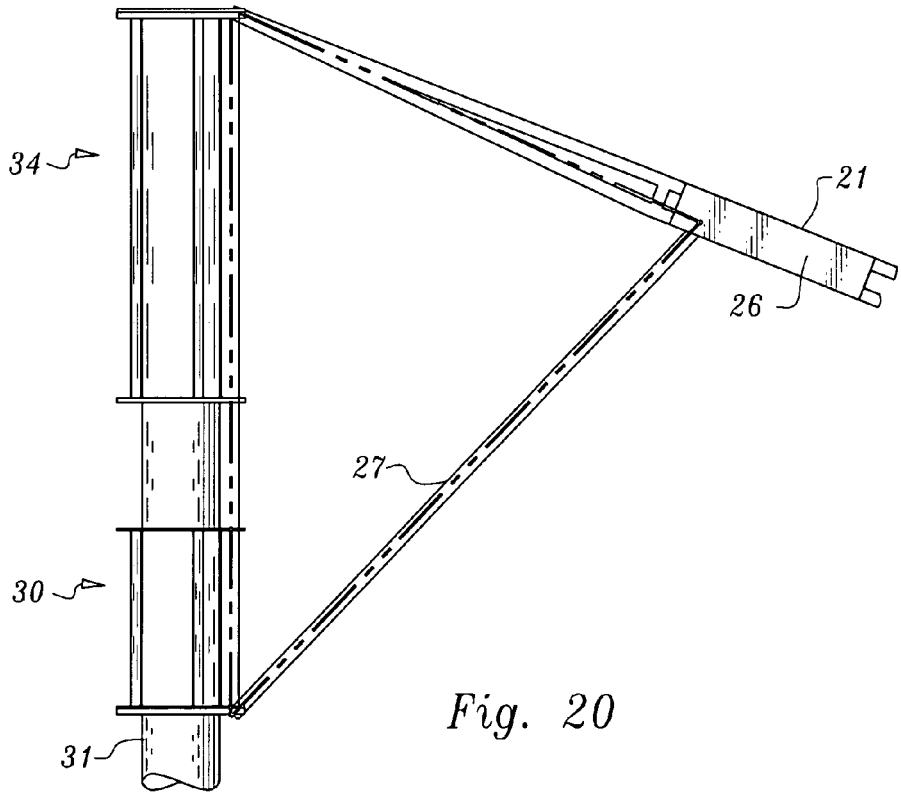
FIG. 20 is a diagrammatic view pertaining to the mode of calculation for the triangles depicted in FIGS. 19A and 19B.

As can be seen by a reference to FIG. 20, the triangles depicted in FIGS. 19A and 19B are calculated not on the ribs and spars, but along the three imaginary lines from the center of the three pivot points; namely on the upper hub 34, the lower hub 30, and the junction of the rib 27 with the rib joiner plates 26. The first triangle shown in FIG. 19A has been superimposed on the simplified view of a portion of the total apparatus in FIG. 20 and the points 250, 260 and 270 have been noted thereon. Since the uppermost of the lines is measured to the bottom of the rib joiner plates 26, there is as slight offset of the line from the spar.

It is also important to understand the nomenclature associated with this industry. The terms 25 foot umbrella and 40 foot umbrella do not pertain to the combination of the extension of the two spars combined with the thickness of the pole. The terms refer to the horizontal distance measured from one spar, through the pole to an opposed spar, when the umbrella is in the open position. Stated another way, the terms refer to the respective diameter of the circle of the protected area beneath the umbrella, when the umbrella is raised to the open position.

It has been found that umbrellas made according to the ratios shown in will open and close smoothly, no matter how powered—crank or motor, and will clear the tables or chairs sitting thereunder.

As to the pole 31, it is made of aluminum or stainless steel but polycarbonate poles are also contemplated. The pole may range in diameter from about 6 inches in diameter to about 9 inches in diameter, and may range in elevation from the ground about 15 feet to about 21 feet, depending upon the span of the umbrella. The pole may be purchased from such vendors as American Steel, located in Philadelphia, Pa. It is to be understood that the pole is one piece from the finial to the ground, unlike home umbrellas where the umbrella portion is overlaid onto a pole about 30 inches high from the ground. Total elevation of the pole for the 40-foot span unit is about 25 feet, and about 18 feet for the 25-foot span unit as a portion of the pole is embedded into concrete below ground and for support. Of course it is recognized that it is the elevation of the pole that ensures that the umbrella when in closed position or being closed while people are seated there beneath, will clear the seated persons.

Figure 8:
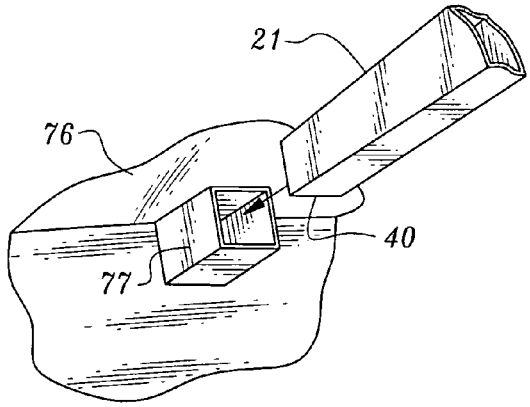
FIG. 8 is a closeup perspective view illustrating the attachment of the umbrella canopy to the spars of this umbrella.

The covering or canopy 76 of the umbrella is added in a conventional fashion by providing a series of mini tapered square cross section sleeves sewn onto the underside of the canopy 76, each to receive the distal end 40 of one spar 21 as shown in FIG. 8. This permits the removal of the canopy for washing or replacement. Other attachment means removable and permanent as known in the art are also contemplated for use in the canopy attachment for this invention. For the 25-foot unit, the edge of the canopy is substantially equal to the edge of the spar, but in the 40-foot unit there is about 1 foot of fabric "overhang". This overhang, is not on the same plane as the elevated spar, but rather the "overhang" is vertically disposed due to it not being supported. This vertical overhang is often scalloped or otherwise decorated for aesthetic reasons. Any conventional fabric such as polypropylene or nylon may be employed for the canopy fabric. A finial may be added to the top of the umbrella after the canopy is secured in place. The attachment may be by any conventional mode, such as by threaded engagement.

The gear motor 60 used to operate the drive system, 61, can be any conventionally available 12 volt—for safety purposes—electric motor of suitable horsepower for the size of the umbrella. See FIG. 9. The gear system is connected to the acme rod, which due to its unique threading causes one hub to move upwardly and one downwardly to open the umbrella. Of course a hand crank with a suitable gear ratio to ease the effort required, can be employed to raise and the lower the umbrella.

Since certain changes may be made in the described apparatus and the method for operating the apparatus without departing from the scope of the invention herein involved, it is intended that all matter contained in the above description and shown in the accompanying drawings shall be interpreted as illustrative and not in a limiting sense.

I claim:

1. An oversized umbrella for shading large numbers of people, which umbrella comprises:

a pair of opposed moving hubs, a first upper and a second lower, both of which hubs ride on a pole, to which hubs are attached a series of spaced spars to the upper hub and a series of spaced ribs to the lower hub;

each of said ribs also being respectively connected to one spar;

an acme-threaded rod, rotatably mounted adjacent said pole, passes through an acme nut mounted on each hub, one of which acme nuts is left hand threaded and one of which is right hand threaded, such that the rod, being connected to a drive shaft and gear set, when actuated causes the hubs both moving toward each other to open the umbrella and cause the hubs both moving away from each other to close the umbrella.

2. The umbrella of claim 1, wherein the spars are each pivotally connected to a respective rib, and the number of spars equals the number of ribs.

3. The umbrella of claim 1, further including a Teflon® or another brand of polytetrafluoroethylene polymer block diposed on said pole, with said threaded acme-threaded rod passing there through to stabilize the acme-threaded rod.

4. The umbrella of claim 3, further including a canopy disposed thereon over the spars.

5. The umbrella of claim 1, wherein each hub comprises a pair of plates, an upper plate and a lower plate, joined together by a series of vertical posts, the lower hub having junction points connecting the ribs in its lower plate and the upper hub having junction points connecting the spars in its upper plate and each hub having means for engaging the acme-threaded rod.

6. An oversized umbrella for shading large numbers of people, which umbrella comprises:

a pole, a pair of opposed moving hubs, a first upper and a second lower hub, both of which hubs ride on the pole, to which upper hub are pivotally attached a series of uniformly laterally arcuately spaced spars; and to which lower hub are pivotally attached a series of uniformly laterally arcuately spaced ribs, at the proximal end of each respective rib;

each of said ribs having a pin passing there through at the distal end of each respective rib, which respective rib is also pivotally connected to one respective spar by said pin being disposed through a pair of rib joiner plates attached to each respective spar, an acme-threaded rod, rotatably mounted adjacent said pole, passes linearly through an acme nut mounted on each hub, one of which acme nuts is left hand threaded and one of which is right hand threaded, such that the rod, when connected to a drive shaft and gear set, and actuated causes the hubs both moving toward each other to close the umbrella and away from each other to open the umbrella.

7. The umbrella of claim 6, wherein the number of spars ranges from 6 to 8, and the rib joiner plates are connected at a point about ⅓ of the distance along the spar as measured from the upper hub.

8. The umbrella of claim 6, wherein each spar is generally trapezoidal in shape and has an upper long member spaced from a lower short member, the upper and lower members, being connected at their extremes by angularly disposed ends, and by member connectors, spaced along the lengths of each of the upper and lower members.

9. The umbrella of claim 8, wherein each said spar's upper member and lower member has two segments, a right segment and a left segment, and the member connectors are attached at a right angle to each of the two left and to each of the two right segments of the spar.

10. The umbrella of claim 8, wherein the rib joiner plates are disposed for their connection to the spar at a point approximately ⅓ the distance along the upper spar as measured from the upper hub, to each of the two upper spar segments.

11. The umbrella of claim 8, wherein a spacing between the upper hub and the lower hub is about 51 inches, and a spacing from the upper hub to the rib jointer plate at the rib is about 37 inches.

12. The umbrella of claim 8, wherein a spacing between the upper hub and the lower hub is about 98.25 inches, and a spacing from the upper hub to the rib jointer plate at the rib is about 71 inches.

13. The umbrella of claim 12, further including a canopy disposed thereon.

14. The umbrella of claim 12, wherein a portion of the pole is set below ground and buried in concrete.

15. The umbrella of claim 12, wherein each hub comprises a pair of plates, an upper plate and a lower plate, joined together by a series of vertical posts, the lower hub having junction points for the ribs in its lower plate and the upper hub having junction points for the spars in its upper plate and each hub having means for engaging an acme threaded rod, and wherein a spacer plate is disposed between the vertical posts and is secured to each of said posts.

16. The umbrella of claim 8, wherein the member connectors are attached at a right angle to each of the two members of the spar.

17. The umbrella of claim 6, further including a motor having a drive shaft, which is engaged to a gear set, and which gear set engages the acme rod to raise and lower the umbrella.

18. An oversized umbrella for shading large numbers of people, which umbrella comprises:

a pole;

a pair of spaced opposed moving hubs, a first upper and a second lower, both of which hubs are disposed around and ride on the pole, each hub comprising two spaced and attached plates, to which upper hub are pivotally attached a series of uniformly horizontal circle segment spaced spars, each of which spars has a left and right segment;

and to which lower hub are pivotally attached a series of uniformly horizontal circle segment spaced ribs, at the proximal end of each respective rib;

each of said ribs being pivotally connected at the distal end of each respective rib to a respective rib joiner plate, disposed on each of the two segments of one spar;

an acme-threaded rod, mounted parallel and adjacent to, but spaced from said pole, passes linearly through an acme nut mounted on each hub, one of which acme nuts is left hand threaded and one of which is right hand threaded, such that the rod, when connected to a drive shaft and gear set, and actuated causes the hubs both moving toward each other to open the umbrella and away from each other to close the umbrella;

and each respective rib is pivotally attached to the lower hub at its proximal end, the number of spars being the same number as the number of ribs.

19. The umbrella of claim 18, farther including a drive shaft and gear set which is connected to a gear motor, and a block disposed on said pole, with said acme-threaded rod passing there through, said acme-threaded rod connected to said drive shaft and engaged to said gear set.

20. The umbrella of claim 19, further including a canopy attached to the spars.

21. The umbrella of claim 20, wherein a finial is secured to the top of the umbrella.

22. The process of claim 21, wherein the hubs are disposed one above the other on the pole, and the upper hub moves upwardly and the lower hub moves downwardly to open the umbrella, and the hubs move toward each other to open the umbrella, and the acme-threaded rod merely rotates.

23. The umbrella of claim 18, wherein each spar is generally trapezoidal in shape and has an upper long member spaced from a lower short member, the upper and lower members, being connected at their extremes by angularly disposed ends, and by member connectors, spaced along the lengths of each of the upper and lower members.

24. The umbrella of claim 18, wherein each of said hubs comprises said spaced and attached plates, an upper plate and a lower plate, joined together by a series of vertical posts, the lower hub having junction points connecting the ribs in its lower plate and the upper hub having junction points connecting the spars in its upper plate and each hub having means for engaging the acme-threaded rod.

* * * * *